US012320533B2

(12) United States Patent
Nair et al.

(10) Patent No.: US 12,320,533 B2
(45) **Date of Patent: *Jun. 3, 2025**

(54) CARBON DIOXIDE BASED VENTILATION MONITORING

(71) Applicants: Meenakshi Nair, Fremont, CA (US); Danika Gupta, Saratoga, CA (US); Shriya Shukla, Foster City, CA (US)

(72) Inventors: Meenakshi Nair, Fremont, CA (US); Danika Gupta, Saratoga, CA (US); Shriya Shukla, Foster City, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/330,228

(22) Filed: Jun. 6, 2023

(65) Prior Publication Data

US 2024/0247828 A1 Jul. 25, 2024

Related U.S. Application Data

(63) Continuation of application No. 18/100,429, filed on Jan. 23, 2023.

(51) Int. Cl.

| | |
|---|---|
| ***F24F 11/00*** | (2018.01) |
| ***F24F 11/526*** | (2018.01) |
| ***F24F 11/72*** | (2018.01) |
| ***F24F 110/70*** | (2018.01) |
| ***F24F 120/14*** | (2018.01) |

(52) U.S. Cl.

CPC ..... *F24F 11/0001* (2013.01); *F24F 11/526* (2018.01); *F24F 11/72* (2018.01); *F24F 2110/70* (2018.01); *F24F 2120/14* (2018.01)

(58) Field of Classification Search

CPC ..... F24F 11/0001; F24F 11/526; F24F 11/72; F24F 2110/70; F24F 2120/14

USPC ..... 454/229

See application file for complete search history.

(56) References Cited

U.S. PATENT DOCUMENTS

| | | | | |
|---|---|---|---|---|
| 6,919,809 | B2 * | 7/2005 | Blunn | F24F 11/61 340/532 |
| 2015/0300670 | A1 * | 10/2015 | Sakamoto | F24F 11/0001 165/244 |
| 2016/0341603 | A1 * | 11/2016 | Kusukame | F24F 11/00 |
| 2023/0054957 | A1 * | 2/2023 | Furuya | G01N 33/004 |

FOREIGN PATENT DOCUMENTS

| | | | |
|---|---|---|---|
| CN | 205484277 U | * | 8/2016 |
| WO | WO-2019142599 A1 | * | 7/2019 |

* cited by examiner

*Primary Examiner* — Allen R. B. Schult

(74) *Attorney, Agent, or Firm* — Kunzler Bean & Adamson

(57) ABSTRACT

Apparatuses, systems, methods, and computer program products for carbon dioxide based ventilation monitoring are described. An apparatus may include a carbon dioxide sensor, a processor, and/or a memory storing computer program code executable by the processor to perform operations. An operation may include interpolating a ventilation metric for an environment of a carbon dioxide sensor based at least partially on data from the carbon dioxide sensor using carbon dioxide as a proxy for ventilation. An operation may include performing a predefined action based on a ventilation metric.

18 Claims, 4 Drawing Sheets

CARBON DIOXIDE BASED VENTILATION MONITORING

CROSS-REFERENCES TO OTHER APPLICATIONS

This application is a continuation of U.S. patent application Ser. No. 18/100,429 entitled "CARBON DIOXIDE BASED VENTILATION MONITORING" and filed on Jan. 23, 2023, for Meenakshi Nair, et al., which is incorporated herein by reference.

FIELD

This invention relates to ventilation monitoring and more particularly relates to carbon dioxide based ventilation monitoring.

BACKGROUND

Ventilation may mitigate the spread of airborne pathogens, improve available oxygen levels, and have other benefits. However, many buildings have not been designed with ventilation in mind, or may not have sufficient ventilation for the number of people present.

SUMMARY

Apparatuses for carbon dioxide based ventilation monitoring are presented. In one embodiment, an apparatus includes one or more of a carbon dioxide sensor, a processor, and/or a memory. A memory, in some embodiments, stores computer program code executable by a processor to perform operations. An operation, in one embodiment, includes interpolating a ventilation metric for an environment of a carbon dioxide sensor based at least partially on data from the carbon dioxide sensor using carbon dioxide as a proxy for ventilation. An operation, in a further embodiment, includes performing a predefined action based on a ventilation metric.

Other apparatuses for carbon dioxide based ventilation monitoring are presented. In one embodiment, an apparatus includes means for determining a carbon dioxide level. An apparatus, in a further embodiment, includes means for interpolating a ventilation metric for an environment based at least partially on a determined carbon dioxide level using carbon dioxide as a proxy for ventilation. An apparatus, in some embodiments, includes means for performing a predefined action based on a ventilation metric.

Methods for carbon dioxide based ventilation monitoring are presented. In one embodiment, a method includes determining a carbon dioxide level. A method, in a further embodiment, includes interpolating a ventilation metric for an environment based at least partially on a determined carbon dioxide level using carbon dioxide as a proxy for ventilation. A method, in some embodiments, includes performing a predefined action based on a ventilation metric.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Aspects of the present invention are described herein with reference to system diagrams, flowchart illustrations, and/or block diagrams of methods, apparatuses, systems, and computer program products according to embodiments of the invention. It will be understood that blocks of the flowchart illustrations and/or block diagrams, and combinations of blocks in the flowchart illustrations and/or block diagrams, can be implemented by computer readable program instructions.

Figure 1:
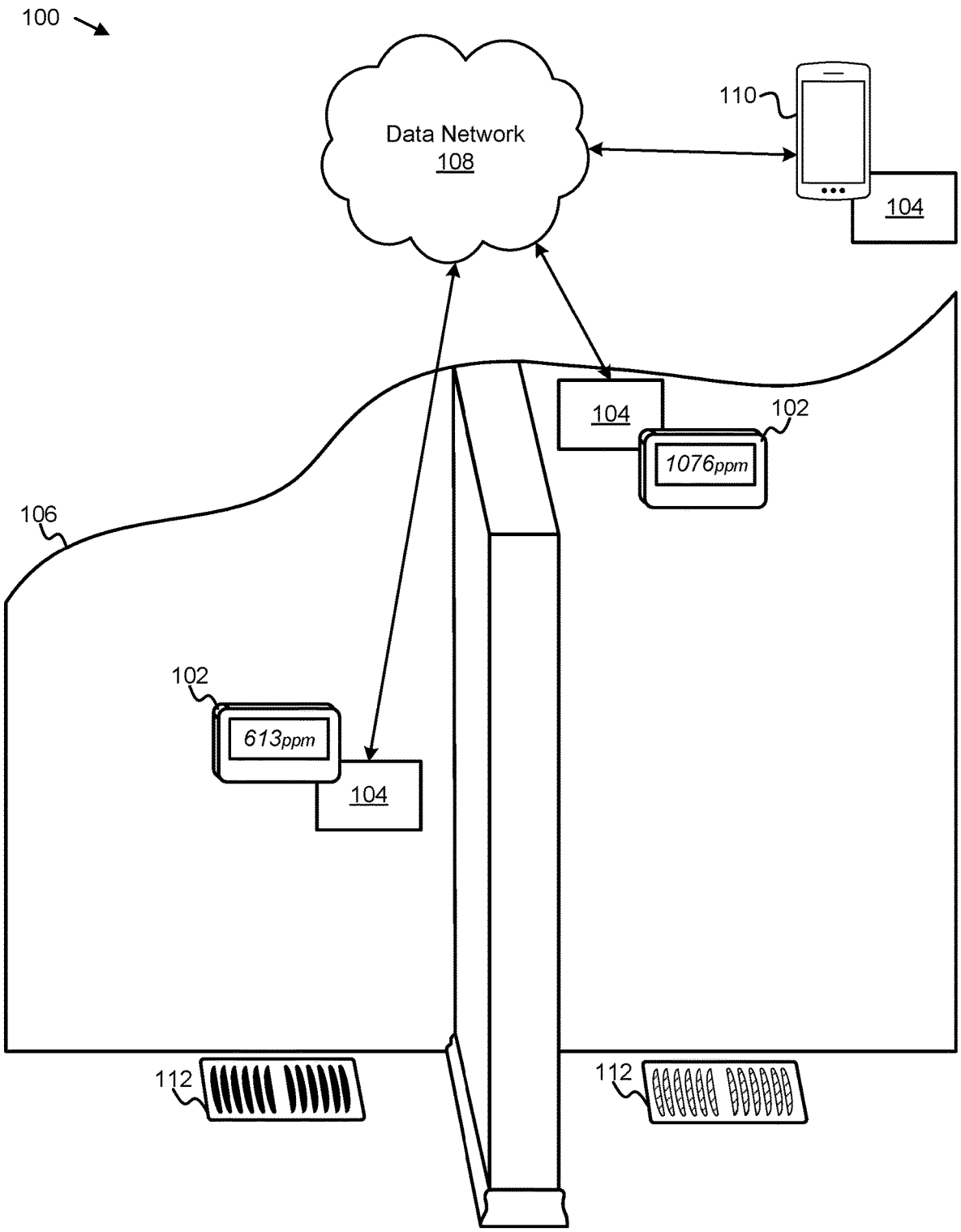
FIG. 1 is a perspective view illustrating one embodiment of a system for carbon dioxide based ventilation monitoring.

FIG. 1 depicts one embodiment of a system 100 for carbon dioxide based ventilation monitoring. The system 100, in the depicted embodiment, includes one or more carbon dioxide sensors 102, one or more controllers 104, a building 106, a data network 108, one or more computing devices 110, and one or more ventilation devices 112.

In general, a controller 104 is configured to interpolate a ventilation metric for an environment based at least partially on data from a carbon dioxide sensor 102 (e.g., using carbon dioxide as a proxy for ventilation, or the like) and to perform a predefined action based on the ventilation metric. In this manner, in certain embodiments, a system 100 may report and/or manage ventilation for a building 106 and/or another environment based on a carbon dioxide concentration, thereby enabling users to optimize a number of occupants in order to reduce and/or limit transmission of airborne pathogens, or the like. For example, business owners, home owners, and/or other users may use a controller 104 to monitor and/or improve ventilation in a building 106 and/or other environment.

A controller 104, in some embodiments, may use a combination of edge carbon dioxide sensors 102 and/or machine learning to monitor and/or forecast carbon dioxide levels (e.g., as a proxy for ventilation, or the like). In embodiments where carbon dioxide sensors 102 are not available, and/or in addition to using carbon dioxide sensors 102, a controller 104 may use one or more machine learning and/or other artificial intelligence algorithms to forecast and/or predict carbon dioxide levels (e.g., from other environmental data such as temperature, humidity, historical carbon dioxide levels, total volatile organic compounds (TVOC), particulate matter (PM) concentration such as PM2.5 (a concentration of particles 2.5 micrometers and smaller) and/or PM10 (a concentration of particles 10 micrometers and smaller), or the like).

Carbon dioxide levels can vary between locations and/or across time within a single location, based on ventilation, occupancy, or the like. A controller 104, may receive data from one or more carbon dioxide sensors 102 disposed in a building 106 or other environment (e.g., in order to monitor and/or detect changes in carbon dioxide levels over time), and may interpolate a ventilation metric based at least partially on the data from the one or more carbon dioxide sensors 102.

A controller 104 may be configured to perform a predefined action based on a ventilation metric, such as opening and/or adjusting an automated vent 112 or other ventilation device 112, increasing or otherwise adjusting a speed of a fan 112, providing a user interface and/or other notification to a user (e.g., a graphical user interface (GUI), an application programming interface (API), a push notification, a text message, an email, or the like) based on the ventilation metric. For example, in some embodiments, a controller 104 may comprise and/or be in communication with computer program code installed and/or executing on a computing device 110, or the like such as a mobile application, a desktop application, a server application, or other computer program code executable by a processor and may display a user interface and/or perform a different action on a display screen of and/or using other hardware of the computing device 110.

A controller 104, in certain embodiments, either in conjunction with data from one or more carbon dioxide sensors 102 or as a replacement for them, may forecast and/or otherwise predict one or more future carbon dioxide level and/or ventilation metrics (e.g., hourly, daily, weekly, monthly predictions, or the like). For example, a controller 104 may provide long range forecasting of carbon dioxide levels and/or ventilation metrics, in order to enable a user to manage ventilation (e.g., opening a window, restricting entry of additional occupants, reducing a number of occupants, or the like). In some embodiments, a controller 104 may predict a carbon dioxide level at about a same resolution and/or accuracy level as a carbon dioxide sensor 102, or the like (e.g., predicting a carbon dioxide level within about 30-40 parts per million (ppm), or the like). In one embodiment, a controller 104 predicts a carbon dioxide level and/or a ventilation metric based at least in part on past carbon dioxide readings from one or more carbon dioxide sensors 102. In a further embodiment, a controller 104 predicts a carbon dioxide level and/or a ventilation metric based on one or more other environmental metrics such as a temperature, a humidity level, a volatile organic compound level, a particulate matter level, or the like.

For example, in various embodiments, a controller 104 may predict one or more carbon dioxide levels and/or ventilation metrics using machine learning and/or other artificial intelligence, such as a K-Nearest Neighbors (KNN) algorithm, a Random Forest algorithm, a Linear Regression algorithm, a Linear Support Vector Regressor algorithm, a Multi-Layer Perceptron (MLP) algorithm, or the like. One or more parameters of the machine learning and/or other artificial intelligence may be tuned for carbon dioxide level and/or ventilation metric prediction, such as tuning K for a KNN algorithm, tuning a number of trees for a Random Forest algorithm, feature normalization and/or turning intercepts on/off for a Linear Regression algorithm, a number of connected network topologies and/or number of hidden layers for an MLP algorithm, or the like. For an MLP algorithm, in one embodiment, a learning rate may be varied while one or more other parameters may be fixed (e.g., activation may be set at "relu", solver may be set at "adam", alpha may be set at "0.0001", epochs may be set at "200", early stopping may be enabled, or the like).

In some embodiments, a controller 104 may train machine learning and/or other artificial intelligence separately for each individual location (e.g., a controller 104, a building 106, a zone and/or region within a building 106, another environment, or the like). For example, different locations may have more predictable carbon dioxide and/or ventilation patterns, different carbon dioxide and/or ventilation patterns, or the like.

A controller 104, in some embodiments, may support multiple sources and/or input methods for carbon dioxide data. In one embodiment, a controller 104 may receive data from a carbon dioxide sensor 102 over a wireless and/or wired data network 108, such as a wireless Bluetooth® connection, a wireless Wi-Fi connection, a wired ethernet connection, a wired universal serial bus (USB) connection, or the like. In a further embodiment, as described in greater detail below with regard to FIG. 2, a controller 104 may use one or more cameras or other image sensors to recognize a visual representation of data from a carbon dioxide sensor 102 (e.g., numbers or other text on an electronic display screen of a carbon dioxide sensor 102, a needle or other meter indicator on a carbon dioxide sensor 102, or the like), using machine learning and/or other artificial intelligence image recognition, or the like. In certain embodiments, a controller 104 may receive manually input/entered data (e.g., which a user may read from a carbon dioxide sensor 102 and/or another source) through a user interface (e.g., a GUI such as an application executing on a computing device 110 and/or a web interface over a data network 108, an API, a command line interface (CLI), voice recognition, or the like). For example, a controller 104 may access an online spreadsheet, database, document, data file, or the like over a data network 108, which a user has populated (e.g., typed, copied and pasted, or the like) carbon dioxide level data, other environmental data, or the like. In this manner, in some embodiments, a user may utilize a controller 104 for managing ventilation, even if a carbon dioxide sensor 102 is not available, does not support a communications standard and/or medium of the controller 104 and/or of a computing device 110, or the like.

A controller 104, in one embodiment, interpolates and/or otherwise determines a ventilation metric based at least partially on data from a carbon dioxide sensor 102. A ventilation metric, as used herein, comprises a representation and/or indicator of a ventilation state for an environment (e.g., low/medium/high, safe/dangerous, green/yellow/red, an actual and/or estimated flow rate, a recommended number of occupants, or the like).

A controller 104 may process and/or analyze data from a carbon dioxide sensor 102 to determine a ventilation metric. In some embodiments, a controller 104 may provide data from one or more carbon dioxide sensors 102 (e.g., carbon dioxide levels, or the like) as inputs into machine learning and/or other artificial intelligence and may receive a ventilation metric as an output. In a further embodiment, a controller 104 may compare data from a carbon dioxide sensor 102 to one or more thresholds to determine a ventilation metric (e.g., to determine if a carbon dioxide level satisfies one or more thresholds, falls within one or more predefined ranges, or the like). For example, a controller 104 may maintain and/or otherwise determine one or more thresholds, two or more ranges, or the like of carbon dioxide levels mapped to and/or otherwise associated with different ventilation metrics (e.g., different thresholds and/or ranges for low/medium/high, safe/dangerous, green/yellow/red, different flow rates, different numbers of occupants, or the like).

A controller 104, in one embodiment, may be configured to perform a predefined action based on a ventilation metric (e.g., in response to the ventilation metric satisfying a threshold, based on a level of the ventilation metric, or the like). In some embodiments, a threshold at which a controller 104 is configured to perform an action is set for a ventilation metric relative to an interpolated level of ventilation (e.g., not based on a safety of the associated carbon dioxide level, which may be safe for humans). For example, a threshold at which a controller 104 is configured to perform an action may be set at a level to discourage and/or reduce airborne transmission of pathogens, not because a carbon dioxide level itself is harmful, or the like.

In one embodiment, a controller 104 may perform an action comprising electromechanically opening a vent 112, a window 112, and/or another ventilation device 112 in fluid communication with an environment around a carbon dioxide sensor 102, or the like. In a further embodiment, a controller 104 may perform an action comprising enabling a fan 112, an air filter 112, and/or another ventilation device 112 in fluid communication with an environment around a carbon dioxide sensor 102, or the like. For example, a controller 104 may send one or more command signals to a ventilation device 112 over a wireless and/or wired data network 108, may be integrated with, hardwired, and/or otherwise in communication with a ventilation device 112, or the like.

A controller 104, in some embodiments, may perform an action comprising notifying a user (e.g., using an electronic display screen of a computing device 110 and/or of a carbon dioxide sensor 102, using an electronic speaker of a computing device 110 and/or of a carbon dioxide sensor 102, or the like). For example, a controller 104 may perform an action notifying a user of a ventilation metric, of a carbon dioxide level, of a recommended number of people for an environment, to reduce a number of people present in an environment, or the like, based on a ventilation metric and/or a carbon dioxide level.

For example, in a GUI on an electronic display screen of a computing device 110, a controller 104 may display a most recent ventilation metric, carbon dioxide level, temperature, humidity, pressure, other environmental metrics, or the like; may display a graph, one or more trends, and/or another history of previous ventilation metrics, carbon dioxide levels, temperatures, humidities, pressures, other environmental metrics, or the like (e.g., in an interactive GUI which a user may select starting and/or ending dates, zoom into different time periods, select different data elements, or the like); may display one or more recommendations and/or other notifications; and/or other user interface elements based on a ventilation metric and/or a carbon dioxide level. A controller 104, in other embodiments, may display one or more metrics for a carbon dioxide sensor 102, such as a battery level, a device identifier, one or more settings, or the like.

A controller 104, in some embodiments, may display a ventilation metric in a manner to provide context and/or explanation for a carbon dioxide level. For example, in an embodiment where a ventilation metric comprises a red, yellow, and/or green color (e.g., indicating a safety level of interpolated ventilation with regard to airborne spread of pathogens, or the like), a controller 104 may display a carbon dioxide level, an icon, and/or another user interface element in the color of the ventilation metric (e.g., red for a high/dangerous range, yellow for a middle/medium/average range, green for a low/healthy range, or the like). In a further embodiment, a controller 104 may provide one or more recommendations to a user on how to improve ventilation, when to improve ventilation, or the like (e.g., open a window at 3:00 PM, turn on a fan in the morning, or the like).

In some embodiments, a controller 104 may comprise logic hardware such as one or more of a processor (e.g., a CPU, a microcontroller, firmware, microcode, an application specific integrated circuit (ASIC), a field programmable gate array (FPGA) or other programmable logic, or the like), a volatile memory, a non-volatile computer readable storage medium, a network interface, a printed circuit board, or the like. A controller 104, in further embodiments, may include computer program code stored on a non-transitory computer readable storage medium (e.g., of a computing device 110 and/or of a carbon dioxide sensor 102), executable by a processor to perform one or more of the operations described herein, or the like.

A controller 104, in certain embodiments, may receive user input from a carbon dioxide sensor 102 (e.g., from a button, switch, touchscreen, and/or other user interface element), from a remote control device (e.g., an infrared remote control, a radio frequency remote control, a Bluetooth® remote control, or the like), from a user interface of a computing device 110 over a data network 108 (e.g., a mobile computing device such as a smartphone, a smart watch, a tablet, a laptop, or the like; a desktop computer; a gaming device; a set-top box; a point-of-sale device, and/or another computing device 110 comprising a processor and a memory).

The data network 108, in one embodiment, includes a digital communication network that transmits digital communications. The data network 108 may include a wireless network, such as a wireless cellular network, a local wireless network, such as a Wi-Fi network, a Bluetooth® network, a near-field communication (NFC) network, an ad hoc network, or the like. The data network 108 may include a wide area network (WAN), a local area network (LAN), an optical fiber network, the internet, or other digital communication network. The data network 108 may include a combination of two or more networks. The data network 108 may include one or more servers, routers, switches, and/or other networking equipment.

One or more controllers 104, carbon dioxide sensors 102, ventilation devices 112, and/or computing devices 110 may be in communication over a data network 108, either directly or through a backend server computing device, or the like. A controller 104 executing on a computing device 110 (e.g., computer executable program code, an installable application, a mobile application, or the like), in some embodiments, may provide a user interface to notify a user and/or for a user to perform one or more actions and/or selections described herein.

In some embodiments, a controller 104 may be configured to track one or more occupants and/or other users in an environment (e.g., in and/or around a building 106, in and/or around a room or hallway of a building 106, within a predefined zone of a building 106, around a carbon dioxide sensor 102, or the like). For example, a controller 104 may maintain an occupant count, track occupant locations, or the like, and may determine a ventilation metric based on both data from a carbon dioxide sensor 102 and an occupant count, occupant locations, and/or other location data for one or more occupants. In certain embodiments, a controller 104 may communicate with one or more location sensors in order to track occupants, such as a global positioning system (GPS) sensor of a computing device 110, an image sensor such as a camera that has detected a presence of an occupant, a motion sensor, one or more cell towers and/or wireless routers (e.g., to determine a location using triangulation), or the like. A controller 104 may determine a recommendation for a user, such as a recommendation to reduce a number of occupants, a recommended number of occupants, or the like based on a number and/or a location of one or more tracked occupants.

Figure 2:
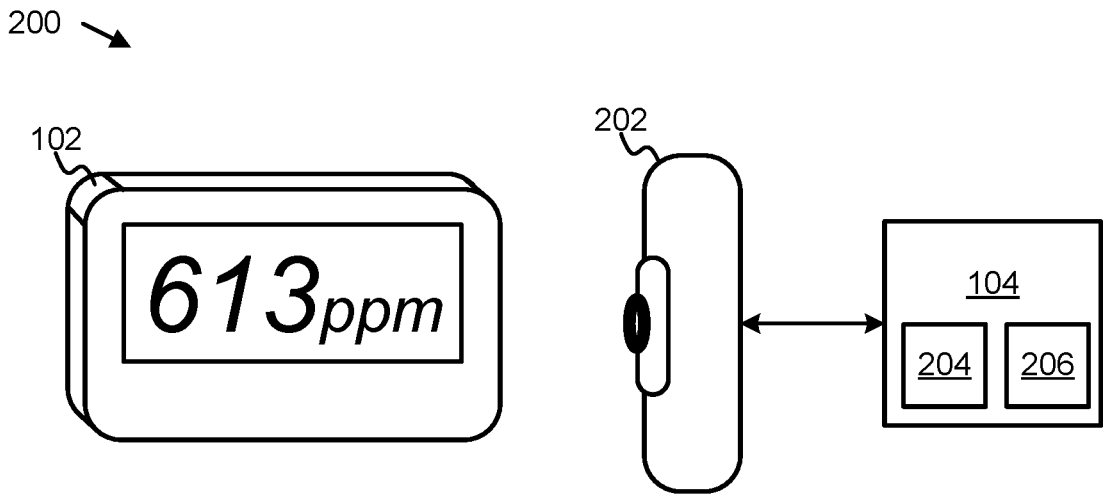
FIG. 2 is a schematic block diagram illustrating a further embodiment of a system for carbon dioxide based ventilation monitoring.

FIG. 2 depicts one embodiment of a system 200 for carbon dioxide based ventilation monitoring. The carbon dioxide sensor 102 and/or the controller 104 of FIG. 2, in some embodiments, may be substantially similar to the carbon dioxide sensor 102 and/or the controller 104 described above with regard to FIG. 1. In the depicted embodiment, the system 200 also includes one or more image sensors 202 (e.g., a camera 202, an infrared sensor 202, or the like) and the controller 104 includes a processor 204 and a memory 206.

An image sensor 202, in one embodiment, may comprise a camera 202 integrated with and/or in communication with a computing device 110 (e.g., a smartphone 110 camera 202, a webcam 202, or the like). In a further embodiment, an image sensor 202 may comprise a dedicated camera device 202 installed in view of a carbon dioxide sensor 102, or the like (e.g., a security camera, a network camera, a USB camera, or the like). In some embodiments, a controller 104 may be configured to receive image data (e.g., one or more photos and/or videos) directly from an image sensor 202. In other embodiments, a controller 104 may provide a GUI allowing a user to upload image data (e.g., one or more photos and/or videos) from an image sensor 202 to the controller 104 over a data network 108, or the like.

An image sensor 202 may capture image data (e.g., one or more photos and/or videos, or the like) of an electronic display screen of a carbon dioxide sensor 102, including one or more readings from the carbon dioxide sensor 102 (e.g., a carbon dioxide level, a temperature, a humidity, a pressure, or the like) displayed on the screen. A controller 104, in some embodiments, may process the image data (e.g., one or more photos and/or videos) to recognize a visual representation of the data from the carbon dioxide sensor 102 (e.g., "613 ppm" in the depicted embodiment, or another carbon dioxide level reading, or the like) based on the image data of the carbon dioxide sensor 102. For example, a controller 104 may use machine learning and/or other artificial intelligence image recognition to recognize text of a carbon dioxide level on an electronic display screen of a carbon dioxide sensor 102, or the like.

In this manner, in certain embodiments, even if a user does not have a carbon dioxide sensor 102 that is network enabled (e.g., with Bluetooth®, Wi-Fi, or the like), the user may still make use of a controller 104 (e.g., a mobile application or other computer program code) to improve or otherwise manage ventilation, or the like.

In some embodiments, a controller 104 may comprise computer program code stored in a memory 206 and executable by a processor 204 to perform one or more of the operations described herein with regard to a controller 104. For example, a processor 204 may comprise a CPU, a microcontroller, firmware, microcode, an ASIC, an FPGA or other programmable logic, or the like (e.g., of a computing device 110, of a server, of a carbon dioxide detector 102, or the like), and a memory 206 may comprise a volatile memory, a non-transitory computer readable storage medium, or the like in communication with the processor 204.

Figure 3:
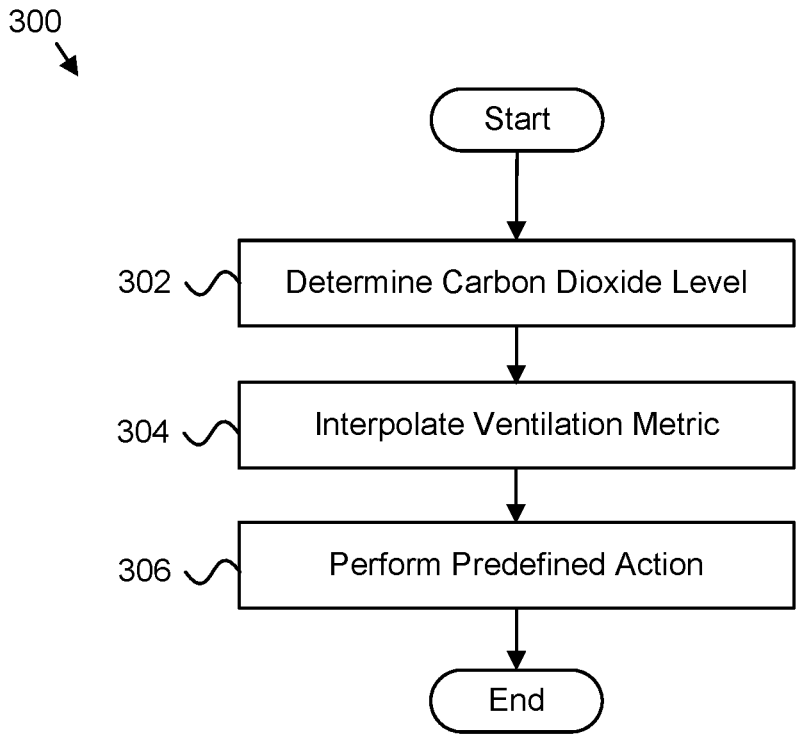
FIG. 3 is a schematic flow chart diagram illustrating one embodiment of a method for carbon dioxide based ventilation monitoring.

FIG. 3 depicts one embodiment of a method 300 for carbon dioxide based ventilation monitoring. The method 300 begins and a controller 104 determines 302 a carbon dioxide level (e.g., based on data from a carbon dioxide sensor 102, as a prediction using machine learning and/or other artificial intelligence, or the like). A controller 104 interpolates 304 a ventilation metric for an environment based at least partially on the determined 302 carbon dioxide level using carbon dioxide as a proxy for ventilation, or the like. A controller 104 performs 306 a predefined action based on the ventilation metric 304 and the method 300 ends.

Figure 4:
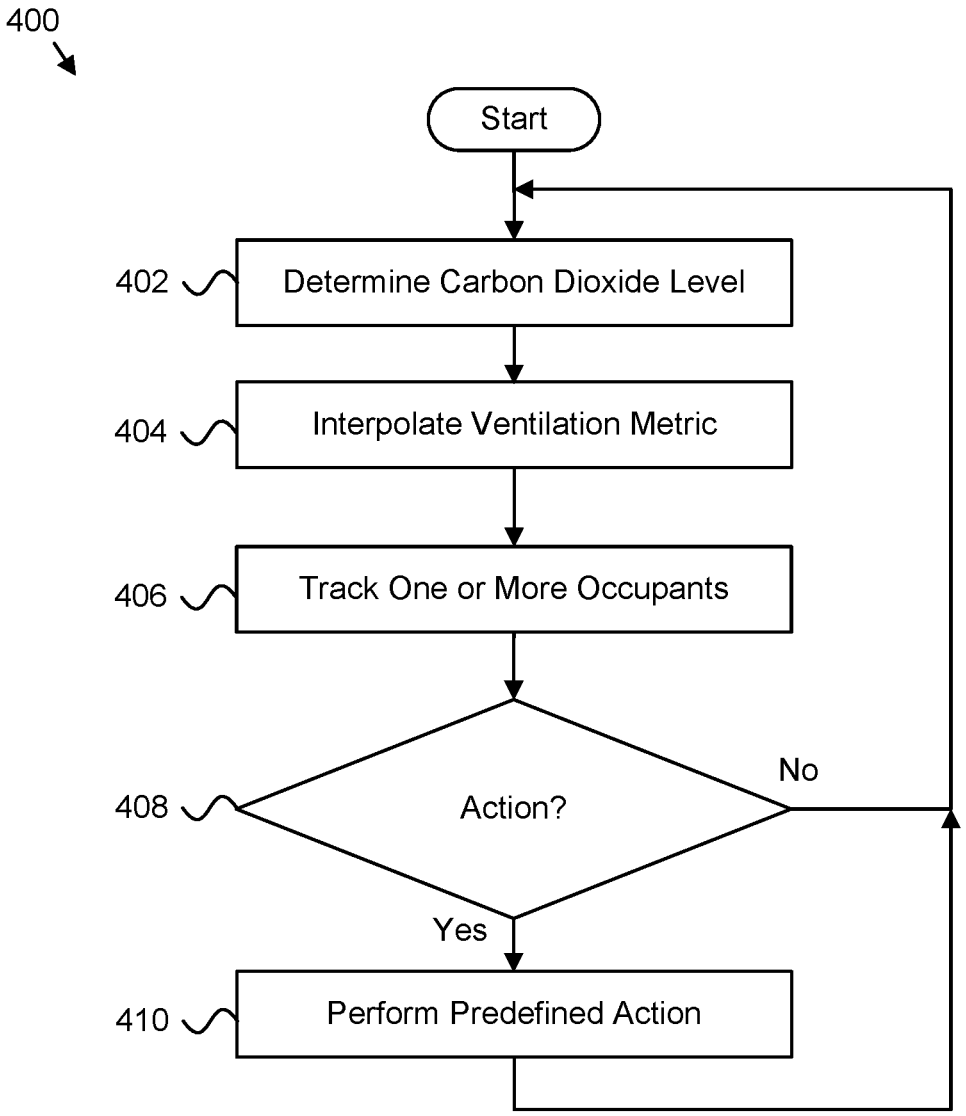
FIG. 4 is a schematic flow chart diagram illustrating one embodiment of another method for carbon dioxide based ventilation monitoring.

FIG. 4 depicts one embodiment of a method 400 for carbon dioxide based ventilation monitoring. The method 400 begins and a controller 104 determines 402 a carbon dioxide level (e.g., based on data from a carbon dioxide sensor 102, as a prediction using machine learning and/or other artificial intelligence, or the like). A controller 104 interpolates 404 a ventilation metric for an environment based at least partially on the determined 402 carbon dioxide level using carbon dioxide as a proxy for ventilation, or the like.

A controller 104 tracks 406 one or more occupants in the environment based on data from one or more location sensors. A controller 104 determines 408 whether or not to perform an action based on one or more of the interpolated 404 ventilation metric and the tracked 406 locations of one or more occupants. If a controller 104 determines 408 to perform an action, the controller 104 performs 410 a predefined action and the method 400 continues with a controller 104 continuing to determine 402 subsequent carbon dioxide levels, interpolate 404 ventilation metrics, or the like.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, advantages, and characteristics of the embodiments may be combined in any suitable manner. One skilled in the relevant art will recognize that the embodiments may be practiced without one or more of the specific features or advantages of a particular embodiment. In other instances, additional features and advantages may be recognized in certain embodiments that may not be present in all embodiments. These features and advantages of the embodiments will become more fully apparent from the following description and appended claims or may be learned by the practice of embodiments as set forth hereinafter.

As will be appreciated by one skilled in the art, aspects of the present invention may be embodied as a system, method, and/or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module," or "system." Furthermore, aspects of the present invention may take the form of a computer program product embodied in one or more computer readable medium(s) having program code embodied thereon.

Many of the functional units described in this specification have been labeled as modules to emphasize their implementation independence more particularly. For example, a module may be implemented as a hardware circuit comprising custom very large scale integrated ("VLSI") circuits or gate arrays, off-the-shelf semiconductor circuits such as logic chips, transistors, or other discrete components. A module may also be implemented in programmable hardware devices such as an FPGA, programmable array logic, programmable logic devices or the like.

Modules may also be implemented in software for execution by various types of processors. An identified module of program code may, for instance, comprise one or more physical or logical blocks of computer instructions which may, for instance, be organized as an object, procedure, or function. Nevertheless, the executables of an identified module need not be physically located together but may comprise disparate instructions stored in different locations which, when joined logically together, comprise the module and achieve the stated purpose for the module.

Indeed, a module of program code may be a single instruction, or many instructions, and may even be distributed over several different code segments, among different programs, and across several memory devices. Similarly, operational data may be identified and illustrated herein within modules and may be embodied in any suitable form and organized within any suitable type of data structure. The operational data may be collected as a single data set or may be distributed over different locations including over different storage devices, and may exist, at least partially, merely as electronic signals on a system or network. Where a module or portions of a module are implemented in software, the program code may be stored and/or propagated on in one or more computer readable medium(s).

The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a server, cloud storage (which may include one or more services in the same or separate locations), a hard disk, a solid state drive ("SSD"), an SD card, a random access memory ("RAM"), a read-only memory ("ROM"), an erasable programmable read-only memory ("EPROM" or Flash memory), a static random access memory ("SRAM"), a Blu-ray disk, a memory stick, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network, a personal area network, a wireless mesh network, and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture ("ISA") instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the C programming language or similar programming languages.

The computer readable program instructions may execute entirely on the user's computer, partly on the user's computer, as a stand-alone software package, partly on the user's computer and partly on a remote computer or service or entirely on the remote computer or server or set of servers. In the latter scenario, the remote computer may be connected to the user's computer through any type of network, including the network types previously listed. Alternatively, the connection may be made to an external computer (for example, through the Internet using an Internet Service Provider). In some embodiments, electronic circuitry including, for example, programmable logic circuitry, FPGA, or programmable logic arrays ("PLA") may execute the computer readable program instructions by utilizing state information of the computer readable program instructions to personalize the electronic circuitry to perform aspects of the present invention.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The schematic flowchart diagrams and/or schematic block diagrams in the Figures illustrate the architecture, functionality, and operation of possible implementations of apparatuses, systems, methods, and computer program products according to various embodiments of the present invention. In this regard, each block in the schematic flowchart diagrams and/or schematic block diagrams may represent a module, segment, or portion of code, which comprises one or more executable instructions of the program code for implementing the specified logical functions.

It should also be noted that, in some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. Other steps and methods may be conceived that are equivalent in function, logic, or effect to one or more blocks, or portions thereof, of the illustrated Figures.

Although various arrow types and line types may be employed in the flowchart and/or block diagrams, they are understood not to limit the scope of the corresponding embodiments. Indeed, some arrows or other connectors may be used to indicate only the logical flow of the depicted embodiment. For instance, an arrow may indicate a waiting or monitoring period of unspecified duration between enumerated steps of the depicted embodiment. It will also be noted that each block of the block diagrams and/or flowchart diagrams, and combinations of blocks in the block diagrams and/or flowchart diagrams, can be implemented by special purpose hardware-based systems that perform the specified functions or acts, or combinations of special purpose hardware and program code.

As used herein, a list with a conjunction of "and/or" includes any single item in the list or a combination of items in the list. For example, a list of A, B and/or C includes only A, only B, only C, a combination of A and B, a combination of B and C, a combination of A and C or a combination of A, B and C. As used herein, a list using the terminology "one or more of" includes any single item in the list or a combination of items in the list. For example, one or more of A, B and C includes only A, only B, only C, a combination of A and B, a combination of B and C, a combination of A and C or a combination of A, B and C. As used herein, a list using the terminology "one of" includes one and only one of any single item in the list. For example, "one of A, B and C" includes only A, only B or only C and excludes combinations of A, B and C. As used herein, "a member selected from the group consisting of A, B, and C," includes one and only one of A, B, or C, and excludes combinations of A, B, and C." As used herein, "a member selected from the group consisting of A, B, and C and combinations thereof" includes only A, only B, only C, a combination of A and B, a combination of B and C, a combination of A and C or a combination of A, B and C.

Means for performing the steps described herein, in various embodiments, may include one or more of a network interface, a controller (e.g., a CPU, a processor core, an FPGA or other programmable logic, an ASIC, a microcontroller, and/or another semiconductor integrated circuit device), a hardware appliance or other hardware device, other logic hardware, and/or other executable code stored on a computer readable storage medium. Other embodiments may include similar or equivalent means for performing the steps described herein.

For example, means for determining a carbon dioxide level, in various embodiments, may include one or more of a carbon dioxide sensor 102, a controller 104 (e.g., a CPU, a processor core, an FPGA or other programmable logic, an ASIC, a microcontroller, and/or another semiconductor integrated circuit device), a computing device 110, an image sensor 202, a hardware appliance or other hardware device, other logic hardware, a computer program product (e.g., a mobile application, a desktop application, microcode, or the like), and/or other executable code stored on a computer readable storage medium. Other embodiments may include similar or equivalent means for determining a carbon dioxide level.

Means for interpolating a ventilation metric for an environment based at least partially on a determined carbon dioxide level using carbon dioxide as a proxy for ventilation, in various embodiments, may include one or more of a carbon dioxide sensor 102, a controller 104 (e.g., a CPU, a processor core, an FPGA or other programmable logic, an ASIC, a microcontroller, and/or another semiconductor integrated circuit device), a computing device 110, a hardware appliance or other hardware device, other logic hardware, a computer program product (e.g., a mobile application, a desktop application, microcode, or the like), a lookup table, a database, another data structure, and/or other executable code stored on a computer readable storage medium. Other embodiments may include similar or equivalent means for interpolating a ventilation metric for an environment based at least partially on a determined carbon dioxide level.

Means for performing a predefined action based on a ventilation metric, in various embodiments, may include one or more of a carbon dioxide sensor 102, a controller 104 (e.g., a CPU, a processor core, an FPGA or other programmable logic, an ASIC, a microcontroller, and/or another semiconductor integrated circuit device), a computing device 110, a ventilation device 112, a hardware appliance or other hardware device, other logic hardware, an electronic display screen, a computer program product (e.g., a mobile application, a desktop application, microcode, or the like), and/or other executable code stored on a computer readable storage medium. Other embodiments may include similar or equivalent means for performing a predefined action based on a ventilation metric.

Means for recognizing a visual representation of a carbon dioxide level, in various embodiments, may include one or more of a carbon dioxide sensor 102, a controller 104 (e.g., a CPU, a processor core, an FPGA or other programmable logic, an ASIC, a microcontroller, and/or another semiconductor integrated circuit device), a computing device 110, an image sensor 202, a hardware appliance or other hardware device, other logic hardware, a computer program product (e.g., a mobile application, a desktop application, microcode, or the like), and/or other executable code stored on a computer readable storage medium. Other embodiments may include similar or equivalent means for recognizing a visual representation of a carbon dioxide level.

Means for tracking one or more occupants in an environment, in various embodiments, may include one or more of a carbon dioxide sensor 102, a controller 104 (e.g., a CPU, a processor core, an FPGA or other programmable logic, an ASIC, a microcontroller, and/or another semiconductor integrated circuit device), a computing device 110, a location sensor, an image sensor 202, a motion sensor, a hardware appliance or other hardware device, other logic hardware, a computer program product (e.g., a mobile application, a desktop application, microcode, or the like), and/or other executable code stored on a computer readable storage medium. Other embodiments may include similar or equivalent means for tracking one or more occupants in an environment.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus, comprising:

one or more image sensors;

a carbon dioxide sensor;

a processor; and a memory storing computer program code executable by the processor to perform operations, the operations comprising:

recognizing a visual representation of display data from the carbon dioxide sensor based on image data of the carbon dioxide sensor from the one or more image sensors, the display data recognized using artificial intelligence image recognition;

forecasting future carbon dioxide levels for an environment of the carbon dioxide sensor using machine learning based on data from the carbon dioxide sensor, the data comprising display data from the carbon dioxide sensor, historical carbon dioxide data that is captured over time from the carbon dioxide sensor, or a combination thereof;

interpolating a ventilation metric for the environment of the carbon dioxide sensor based at least partially on the forecasted carbon dioxide levels as a proxy for ventilation, the ventilation metric comprising an indicator describing a carbon dioxide ventilation state for the environment; and performing a predefined action based on the ventilation metric satisfying a carbon dioxide level threshold, the carbon dioxide level threshold for the ventilation metric set relative to an interpolated level of ventilation.

2. The apparatus of claim 1, further comprising one or more location sensors, wherein the operations further comprise tracking one or more occupants in the environment based on data from the one or more location sensors and the predefined action is performed based on both the ventilation metric and one or more of a location of and a total number of the tracked one or more occupants in the environment.

3. The apparatus of claim 1, wherein the predefined action comprises electromechanically opening one or more of a vent and a window in fluid communication with the environment.

4. The apparatus of claim 1, wherein the predefined action comprises enabling one or more of a fan and a filter in fluid communication with the environment.

5. The apparatus of claim 1, wherein the predefined action comprises notifying a user, using one or more of an electronic display screen and an electronic speaker, a recommended number of people for the environment.

6. The apparatus of claim 1, wherein the predefined action comprises notifying a user, using one or more of an electronic display screen and an electronic speaker, to reduce a number of people present in the environment.

7. The apparatus of claim 1, wherein the threshold is selected based on an estimated transmission rate of one or more pathogens at the interpolated level of the ventilation associated with the ventilation metric at the selected threshold.

8. The apparatus of claim 1, wherein the ventilation metric is further based at least partially on one or more of particulate metrics for the environment and a geography associated with the environment.

9. The apparatus of claim 1, wherein the ventilation metric is mapped to a range of carbon dioxide level thresholds.

10. The apparatus of claim 1, wherein the ventilation state indicates a safety level of the environment.

11. An apparatus comprising:

means for recognizing a visual representation of display data from a carbon dioxide sensor based on image data of the carbon dioxide sensor from one or more image sensors, the display data recognized using artificial intelligence image recognition;

means for forecasting a future carbon dioxide level for an environment using machine learning based on data from the carbon dioxide sensor, the data comprising display data from the carbon dioxide sensor, historical carbon dioxide data that is captured over time from the carbon dioxide sensor, or a combination thereof;

means for interpolating a ventilation metric for the environment based at least partially on the forecasted carbon dioxide level as a proxy for ventilation, the ventilation metric comprising an indicator describing a carbon dioxide ventilation state for the environment; and means for performing a predefined action based on the ventilation metric satisfying a carbon dioxide level threshold, the carbon dioxide level threshold for the ventilation metric set relative to an interpolated level of ventilation.

12. The apparatus of claim 11, further comprising means for tracking one or more occupants in the environment, wherein the predefined action is performed based on both the ventilation metric and one or more of a location of and a total number of the tracked one or more occupants in the environment.

13. The apparatus of claim 11, wherein the predefined action comprises electromechanically opening one or more of a vent and a window in fluid communication with the environment.

14. The apparatus of claim 11, wherein the predefined action comprises enabling one or more of a fan and a filter in fluid communication with the environment.

15. The apparatus of claim 11, wherein the predefined action comprises notifying a user, using one or more of an electronic display screen and an electronic speaker, a recommended number of people for the environment.

16. The apparatus of claim 11, wherein the predefined action comprises notifying a user, using one or more of an electronic display screen and an electronic speaker, to reduce a number of people present in the environment.

17. A method comprising:

recognizing a visual representation of display data from a carbon dioxide sensor based on image data of the carbon dioxide sensor from one or more image sensors, the display data recognized using artificial intelligence image recognition;

forecasting a future carbon dioxide level for an environment using machine learning based on data from the carbon dioxide sensor, the data comprising display data from the carbon dioxide sensor, historical carbon dioxide data that is captured over time from the carbon dioxide sensor, or a combination thereof;

interpolating a ventilation metric for the environment based at least partially on the forecasted carbon dioxide level as a proxy for ventilation, the ventilation metric comprising an indicator describing a carbon dioxide ventilation state for the environment; and performing a predefined action based on the ventilation metric satisfying a carbon dioxide level threshold, the carbon dioxide level threshold for the ventilation metric set relative to an interpolated level of ventilation.

18. The method of claim 17, further comprising tracking one or more occupants in the environment, wherein the predefined action is performed based on both the ventilation metric and one or more of a location of and a total number of the tracked one or more occupants in the environment.

* * * * *